US005957438A

United States Patent [19]

Workman et al.

[11] Patent Number: 5,957,438

[45] Date of Patent: Sep. 28, 1999

[54] SPRING RETAINER ASSEMBLY

[75] Inventors: Joe C. Workman; Henry G. Mohr; Richard L. McCune, all of Carthage, Mo.

[73] Assignee: L&P Property Management Company, South Gate, Calif.

[21] Appl. No.: 09/039,807

[22] Filed: Mar. 16, 1998

Related U.S. Application Data

[60] Provisional application No. 60/073,633, Feb. 4, 1998.

[51] Int. Cl.[6] ..... A47C 27/04; A47C 27/06; B68G 9/00

[52] U.S. Cl. ..... 267/90; 5/655.8; 5/720; 29/91.1

[58] Field of Search ..... 5/655.8, 720; 267/90, 267/91, 94; 29/91, 91.1

[56] References Cited

U.S. PATENT DOCUMENTS

| | | | |
|---|---|---|---|
| 1,153,120 | 9/1915 | Lackey | 5/722 |
| 1,269,018 | 6/1918 | Stevens . | |
| 1,434,653 | 11/1922 | Fiss et al. | 5/720 |
| 1,502,510 | 8/1924 | Marcus et al. | 5/655.8 |
| 1,663,272 | 3/1928 | Kellar | 5/655.8 |
| 1,683,684 | 9/1928 | MacInerney . | |
| 1,724,947 | 8/1929 | Macinerney | 5/655.8 |
| 3,230,558 | 1/1966 | Duncan | 5/720 |
| 3,855,653 | 12/1974 | Stalter, Sr. | 5/721 |
| 4,053,956 | 10/1977 | Higgins . | |
| 4,112,726 | 9/1978 | Adams et al. | 72/137 |
| 4,234,983 | 11/1980 | Stumpf | 5/655.8 |
| 4,234,984 | 11/1980 | Stumpf | 5/720 |
| 4,523,344 | 6/1985 | Stumpf et al. | 5/720 |
| 4,854,023 | 8/1989 | Stumpf | 29/91 |
| 4,907,309 | 3/1990 | Breckle | 5/720 |
| 4,942,636 | 7/1990 | Scott et al. | 5/247 |
| 4,985,952 | 1/1991 | Edelson | 5/420 |
| 5,027,459 | 7/1991 | Perry, Jr. et al. | 5/716 |
| 5,086,529 | 2/1992 | DeGroot . | |
| 5,127,635 | 7/1992 | Long et al. | 267/91 |
| 5,438,718 | 8/1995 | Kelly et al. | 29/91.1 |
| 5,669,093 | 9/1997 | Ogle et al. | 5/655.8 |

FOREIGN PATENT DOCUMENTS

| | | | |
|---|---|---|---|
| 1194621 | 3/1982 | Canada . | |
| 089789A1 | 10/1983 | European Pat. Off. . | |
| 357912A1 | 10/1989 | European Pat. Off. . | |
| 421496A1 | 2/1990 | European Pat. Off. . | |
| 2229194 | 11/1974 | France . | |
| 945591 | 6/1956 | Germany . | |
| 3016914A1 | 11/1981 | Germany . | |
| 3831510A1 | 5/1989 | Germany . | |
| 0001247 | 11/1904 | United Kingdom . | |
| 26847 | 12/1912 | United Kingdom | 5/655.8 |
| 491523 | 9/1938 | United Kingdom | 5/655.8 |
| 759177 | 10/1956 | United Kingdom . | |
| 2143731 | 2/1985 | United Kingdom . | |
| 318141 | 7/1990 | United Kingdom . | |

*Primary Examiner*—Alexander Grosz
*Attorney, Agent, or Firm*—Wood, Herron & Evans, L.L.P.

[57] ABSTRACT

A longitudinally extending spring retainer comprising a band of coil springs and a continuous piece of fabric adapted to hold the band of coil springs. The band of coil springs is made of a single length of wire shaped to form a plurality of coil springs arranged in a row, each of the coil springs having an upper and lower end turn. The upper and lower end turns of the coil springs are held in receptacles created in top and bottom portions of a continuous piece of fabric. The fabric is folded upon itself and secured together with connections in order to hold the end turns in place.

43 Claims, 8 Drawing Sheets

SPRING RETAINER ASSEMBLY

This application is a continuation application of Provisional Patent Application, Ser. No. 60/073,633, filed Feb. 4, 1998, entitled SPRING RETAINER ASSEMBLY and assigned to L&P Property Management Co. which is incorporated by reference herein.

FIELD OF THE INVENTION

This invention relates to spring assemblies for mattresses, cushions and the like and, more particularly, to spring assemblies formed by joining multiple three-sided spring retainers.

BACKGROUND OF THE INVENTION

A known form of a bedding product comprises a plurality of bands of springs disposed side-by-side and connected with helical lacing wires. Most often these continuous bands of springs extend longitudinally and the helical lacing wires extend transversely of the bands and embrace portions of the bands. Several different kinds of bands of springs have been proposed for incorporation into spring interiors of bedding mattresses. One kind of band which is the subject of British patent no. 2,143,731 will hereinafter be referred to as a band of interlocked or interlaced springs. In addition, U.S. Pat. Nos. 4,053,956 and 4,112,726 disclose a band of springs made of a single piece of wire without the convolutions of the coil springs being interlocked or interlaced. In either case, such a band comprises a single length of wire formed to form a plurality of individual coil springs arranged in a row, one end turn of each coil spring lying adjacent to a top face of the band and the other end turn of the coil spring lying adjacent to a bottom face of the band, each coil spring being of a rotational hand either opposite to or of the same rotational hand of the adjacent coils immediately before it in the row and being joined to the adjacent coil springs by a plurality of interconnecting segments of wire integral with the coil springs. One of the pair of interconnecting segments is located in the bottom face of the band and the other of the pair of interconnecting segments is located in the top face of the band.

Another well known type of spring interior of a mattress or cushion comprises a pocketed spring assembly. One type of pocketed spring assembly comprises a plurality of pockets joined together, each pocket containing a continuous row of coil springs. Fabric material is commonly sewn, welded, glued or otherwise secured around a band of continuous coil springs so as to enclose the band within a pocket of fabric. The pockets are then joined together to form a pocketed spring assembly.

U.S. Pat. No. 5,669,093 issued to the assignee of the present invention and herein incorporated by reference discloses a plurality of integrally connected fabric blocks or pockets, each containing a band of coil springs. The blocks or pockets are connected to each other with lines of attachment. Successive lines of attachment are located alternatively in the upper and lower planar surfaces of the assembly as disclosed in U.S. patent application Ser. No. 08/821,393 which is also incorporated by reference herein.

Another patent which discloses a pocketed spring assembly is U.S. Pat. No. 5,127,635 also issued to the assignee of the present invention. This patent discloses a pocketed coil spring assembly in which longitudinally extending bands of coil springs made of one continuous piece of wire are enclosed in fabric covers to form longitudinally extending strips. Within each strip, individual pockets encasing one or more coil springs of a band are formed by connecting opposite sides of the fabric together between the individual coil springs. The fabric pockets are adhesively secured together with conventional adhesive with or without foam pieces inserted between the longitudinally extending strips.

Another known type of spring assembly comprises a plurality of three-sided spring containing strips joined together in order to make a spring assembly. Each strip contains a plurality of individual coil springs placed within a three-sided strip or pocket of fabric, one side of the strip being open. The individual coil springs within the strip are separated from each other by individual fabric partition members which are sewn or otherwise secured to the top and bottom of the three-sided fabric strip. A plurality of strips are aligned and sewn together in order to make the desired size of spring assembly. U.S. Pat. Nos. 1,663,272 and 1,724,947 disclose such spring containing strips and spring assemblies. One disadvantage to this type of spring assembly is that a separate piece of fabric (partition member) must be sewn between each individual coil spring thus increasing the time and labor costs required to make a strip and an assembly of strips.

Therefore, it has been one objective of the present invention to provide a three-sided spring retainer capable of holding a band of coil springs made of a single length of wire.

It has been another objective of the present invention to provide a three-sided spring retainer in which the individual coil springs are held in place without the use of additional strips or partitions of fabric material.

It has further been an objective of the present invention to provide a spring assembly in which three-sided spring retainers or strips are encased within conventional fabric pockets and multiple pockets joined to make a spring assembly.

It has been a further objective of the present invention to provide a three-sided spring retainer which may be manufactured less expensively than heretofore known three-sided spring retainers.

SUMMARY OF THE INVENTION

The invention of this application which accomplishes these objectives comprises a spring retainer adapted to be combined with other like spring retainers to form a spring assembly. The spring retainer has a longitudinal dimension and a transverse dimension, the longitudinal dimension being greater than the transverse dimension. The spring retainer comprises a continuous band of coil springs and a continuous piece of fabric folded longitudinally so as to form top, bottom and side portions, one side of the spring retainer being open. The continuous piece of fabric is overlapped in the top and bottom portions so that each of the top and bottom portions have an upper ply and a lower ply defining a receptacle therebetween.

The band of coil springs is made of a single length of wire shaped to form a plurality of coil springs arranged in a row. The band of coil springs is surrounded on three sides by the fabric. Each of the coil springs of the band has an upper and lower end turn, the end turns of the coil springs being inserted into the receptacles of the top and bottom portions of the fabric. In order to prevent the end turns of the coil springs from moving longitudinally, the upper and lower plies of the top and bottom portions of the fabric are joined with connections. The upper and lower plies of the top and bottom portions of the fabric may be welded, sewn or glued together in order to make the connections.

The spring retainers of the present invention may be inserted into pockets of fabric and the pockets joined together in order to form a pocketed coil spring assembly. One spring retainer is contained within each pocket. Adjacent pockets may be glued, sewn or joined in any other manner to each other. Two sheets of fabric may be joined by lines of attachment forming a plurality of fabric pockets and a spring retainer placed inside each block or pocket in order to form a pocketed spring assembly. The lines of attachment may be located in either the upper or lower surface of the pocketed coil spring assembly as disclosed in U.S. Pat. No. 5,669,093 which is herein incorporated by reference or may alternatively be located between the upper and lower surfaces of the pocketed spring assembly.

In addition, a spring assembly may be manufactured by aligning a plurality of spring retainers in a similar orientation such that the closed side of one fabric retainer is adjacent the open side of an adjacent fabric retainer. Such aligned spring retainers may then be joined by supplemental fabric strips or sheets. The supplemental fabric strips may extend generally parallel the longitudinal dimension of the spring retainers with each supplemental fabric strip being secured to the top or bottom portion of fabric of two adjacent spring retainers. Alternatively, the supplemental fabric strips may extend generally perpendicular to the longitudinal dimension of the spring retainers in the upper and lower surfaces of the spring assembly. Still yet, whole sheets may be used to secure a plurality of spring retainers to each other.

Another embodiment of a spring retainer of the present invention has an extension flap formed in the top and bottom portions of fabric. The extension flaps are used to join adjacent spring retainers to each other in order to create a spring assembly. The extension flaps of one spring retainer may be secured to the top and bottom portions of fabric of an adjacent spring retainer. Alternatively, the extension flaps of one spring retainer may be secured to the side portion of fabric of the adjacent retainer. In either case, the extension flaps of one spring retainer may be sewn, glued or welded to the fabric of an adjacent retainer to join the spring retainers.

Thus, by using either supplemental fabric strips, sheets or spring retainers having extension flaps, any number of spring retainers can be joined together quickly and inexpensively in order to form the desired size spring assembly. These and other objects and advantages of the invention of this application will become more readily apparent from the following description of the drawings.

DETAILED DESCRIPTION OF THE DRAWINGS

Figure 1:
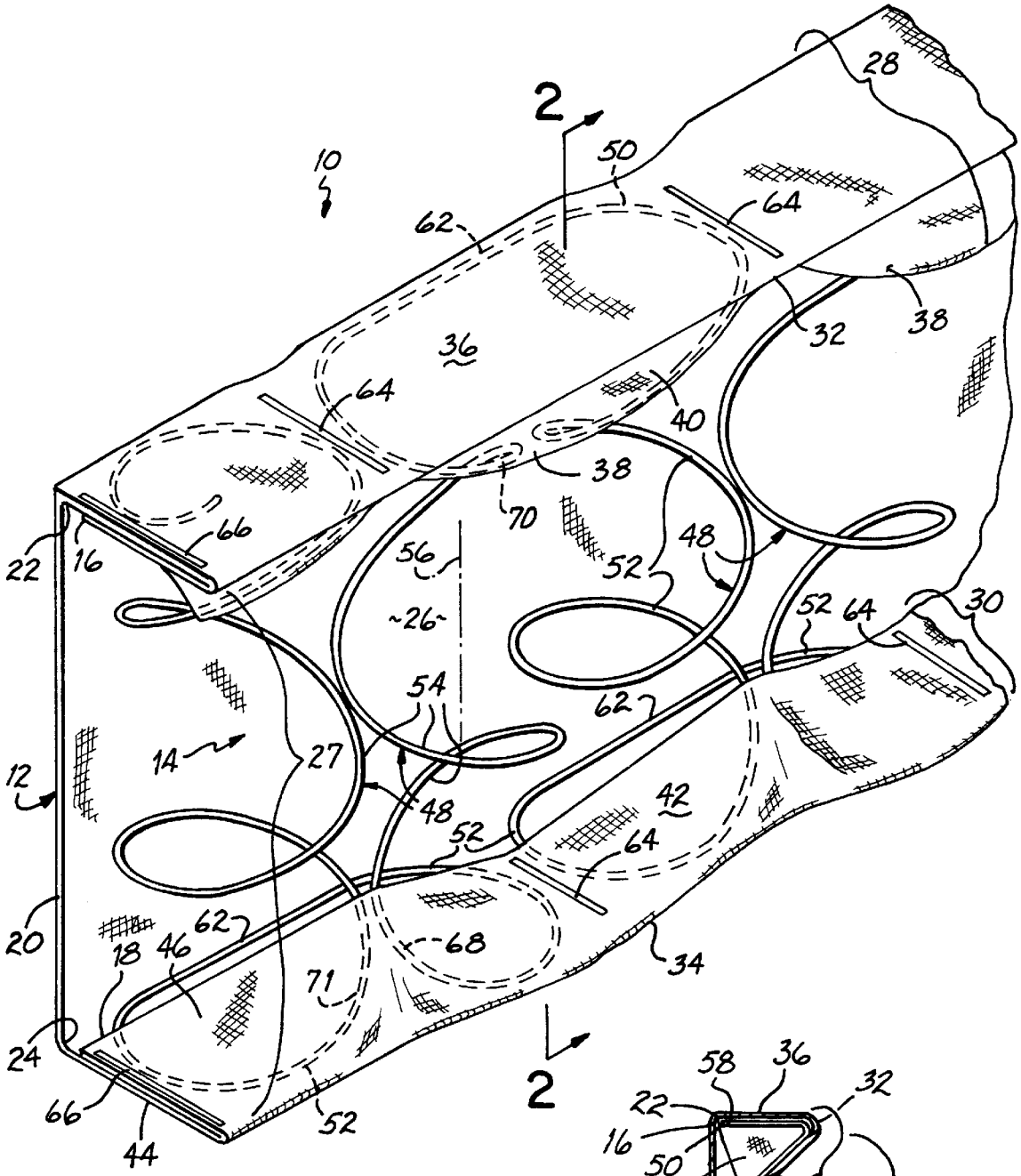
FIG. 1 is a perspective view of one embodiment of the spring retainer of the present invention.

Referring to the drawings, and particularly to FIG. 1, there is illustrated a spring retainer 10. The spring retainer 10 comprises a continuous piece of fabric 12 and a band of coil springs 14. The continuous piece of fabric 12 has a top edge 16, a bottom edge 18 and two opposed side edges 20. The distance between the two opposed side edges 20 (only one shown) defines the longitudinal dimension of the spring retainer 10. The continuous piece of fabric 12 is folded longitudinally along a first fold line 22 and a second fold line 24 in order to form a generally C-shaped piece of fabric having a vertically oriented side portion 26 defined between the first and second fold lines 22, 24, a top portion 28 and a bottom portion 30.

The piece of fabric 12 is further folded along a third fold line 32 which causes the top portion of fabric 28 to be overlapped. Likewise, the bottom portion 30 is folded longitudinally along a fourth fold line 34 to overlap the bottom portion 30.

The third fold line 32 creates an upper ply 36 and a lower ply 38 in the top portion of fabric 28, the upper and lower plies 36, 38 defining an upper receptacle 40 therebetween. Likewise, the fourth fold line 34 creates a two-ply bottom portion 30 having an upper ply 42 and a lower ply 44, the upper and lower plies 42, 44 defining a lower receptacle 46 therebetween.

Figure 2:
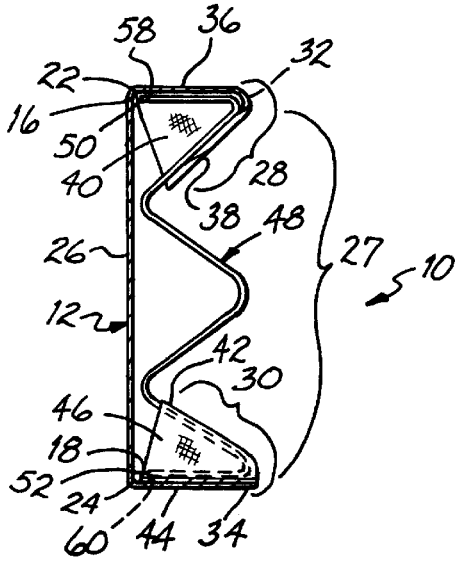
FIG. 2 is a side elevational view of the spring retainer of FIG. 1.

The band of coil springs 14 comprises a plurality of coil springs 48 made of a single length of wire, the coil springs 48 being arranged in a longitudinally extending row. Each coil spring 48 has an upper end turn 50, a lower end turn 52 and a plurality of central convolutions 54 located between the upper and lower end turns. The central convolutions 54 of each coil spring 48 define a coil spring axis 56. The band of coil springs 14 has a top face 58 and a bottom face 60, the upper end turns 50 being located in the top face 58 of the band and the lower end turns 52 being located in the bottom face 60 of the band (see FIG. 2). Adjacent end turns are connected by interconnecting segments 62 located in the top and bottom faces 58, 60 of the band (see FIG. 1). A more complete description of the band of springs 14 may be found in U.S. Pat. No. 5,127,635, the disclosure of which is hereby incorporated by reference.

The upper end turns 50 of the coil springs 48 are placed within the upper receptacle 40 and the lower end turns 52 of the coil springs 48 are placed in the lower receptacle 46. With the band of coil springs 14 located between the top and bottom portions 28, 30 of the continuous piece of fabric 12 and the end turns 50, 52 of the coil springs 48 inserted into the receptacles 40, 46, the coil springs are stabilized or held in place by a plurality of transversely extending connections 64. Each connection 64 joins an upper ply to a lower ply in one of the top or bottom portions of fabric between the end turns of coil springs creating an individual receptacle or cavity. The connections 64 may be sewn lines, glued lines or welded lines, each connection 64 joining an upper ply to a lower ply in either the top or bottom portion of fabric. Alternatively, any other conventional method of joining two pieces of fabric, such as staples, may be utilized in accordance with the present invention. The connections 64 are spaced from one another such that between an adjacent pair of connections 64 there are two end turns of adjacent coil springs and one interconnecting segment 62 connecting the two end turns. Endmost connections 66 prevent the outermost coil springs from separating from the piece of fabric. There are two endmost connections 66 (only one is shown in FIG. 1) in the top portion 28 of fabric and two endmost connections 66 (only one being shown) in the bottom portion 30 of fabric.

As illustrated in FIG. 1, with connections 64 securing an upper ply to a lower ply in both the top and bottom portions of fabric of the retainer, a portion of the upper ply 42 of the bottom portion 30 of fabric rides upwardly over a portion 71 of the central convolutions 54 of two coil springs so that the upper ply 42 has a generally inverted V-shaped configuration between adjacent connections 64. Similarly, the lower ply 38 of the top portion 28 of fabric extends downwardly from the connections 64, covers a portion 70 of the central convolutions 54 of the coil springs and has a generally V-shaped configuration between adjacent connections.

With this configuration of spring retainer, fabric covers the upper and lower end turns of the coil springs limiting the noise or friction between coil springs and resulting in a softer, quieter product. The spring retainer 10 has a closed side 26 and an open side 27.

Figure 3:
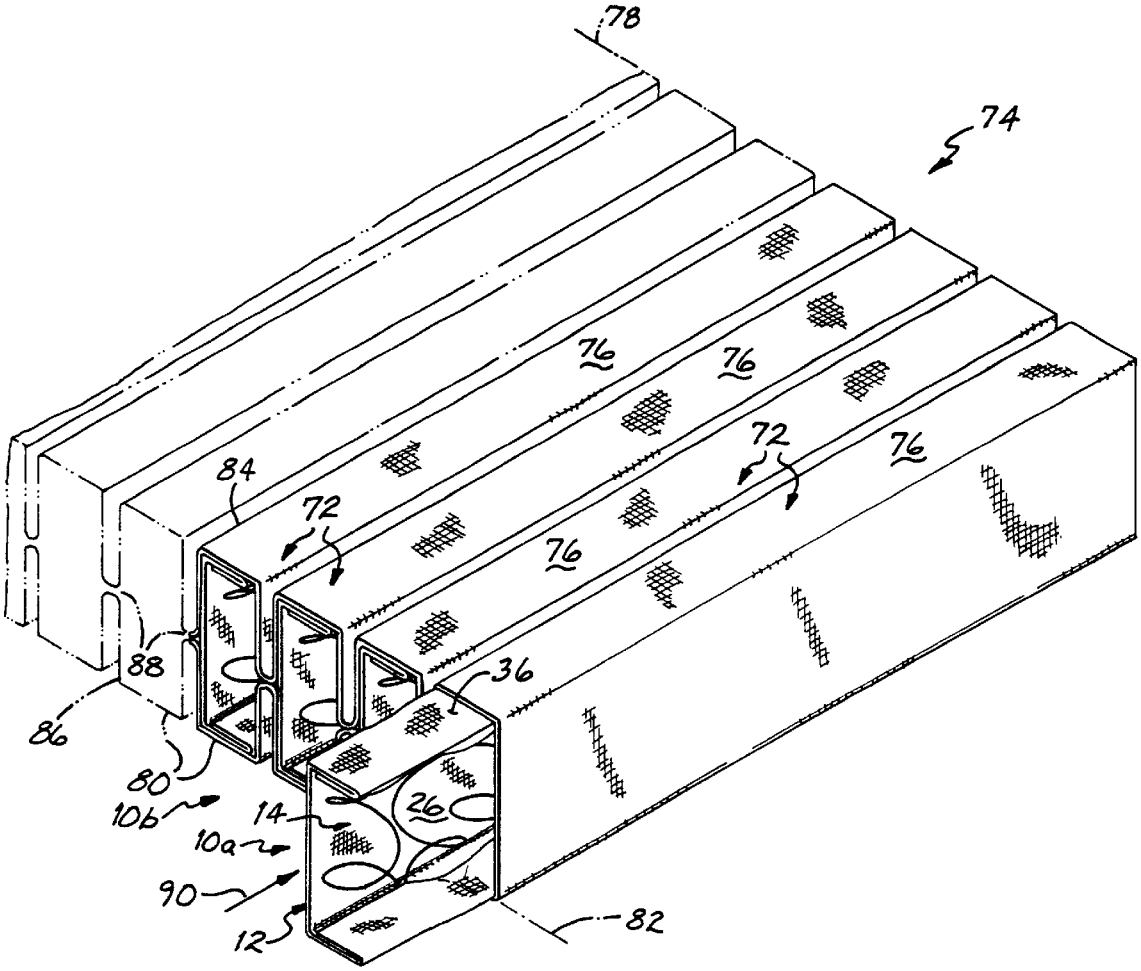
FIG. 3 is a partially disassembled perspective view of a pocketed spring assembly incorporating the spring retainer of the present invention.

Referring to FIG. 3, the spring retainer 10 of FIG. 1 may be inserted into individual pockets 72 of fabric. The pockets 72 may be joined so as to create a pocketed spring assembly 74. The pocketed spring assembly 74 has a planar upper surface 76 in a top plane 78 and a planar lower surface 80 in a bottom plane 82. The pocketed spring assembly 74 may be used in the manufacture of bedding or seating products. If utilized for a bedding product, the pocketed spring assembly 74 may have a longitudinal dimension and a transverse dimension, the longitudinal dimension being greater than the transverse dimension. As illustrated in FIG. 3, the blocks or pockets may extend transversely or alternatively may extend longitudinally although this alternative embodiment is not illustrated.

The pocketed spring assembly 74 comprises a plurality of fabric blocks or pockets 72 joined together. One spring retainer 10*a* is placed in each pocket 72. The pockets 72 may be joined by gluing, welding or sewing adjacent pockets to each other. Pockets 72 may be defined between a first sheet of fabric 84 and a second sheet of fabric 86 by spaced lines of attachment 88. Adjacent pockets 72 may be hingedly connected to each other by a transversely extending line of attachment 88, as illustrated in FIG. 3. Each block or pocket has a spring retainer 10*b* therein inserted in the direction of arrow 90 between the first and second sheets of fabric 84, 86. Although not illustrated, the pockets and lines of attachment joining adjacent pockets may extend longitudinally as well.

One method by which the pocketed spring assembly 74 of FIG. 3 may be made is to form a first fabric pocket and insert a first spring retainer into the first pocket. Similarly, a second fabric pocket is created and a second spring retainer inserted into the second fabric pocket. Once the first and second fabric pockets are formed, the pockets may be attached to each other by sewing, gluing or any other means of attaching adjacent pockets. This process may be repeated with multiple pockets until the appropriate length of spring assembly is obtained.

Another method by which the pocketed spring assembly 74 of FIG. 3 may be made is to vertically space first and second sheets of fabric apart from each other. The first and second sheets are connected along one end edge of the spring assembly. A first spring retainer is inserted between the first and second sheets. The sheets of fabric are then secured together along a line of attachment to form a first pocket or block, the first pocket containing the first spring retainer. A second spring retainer is then inserted between the sheets adjacent the first line of attachment. The first and second sheets are joined together along a second line of attachment. This process is repeated until the appropriate length of spring assembly is obtained. As illustrated in FIG. 3, the lines of attachment 88 may be located between the top and bottom planes (between the upper and lower planar surfaces of the spring assembly). Alternatively, the lines of attachment may be located in the top and bottom planes as described in U.S. Pat. No. 5,669,093. If the lines of attachment are located alternatively in the top and bottom planes of the spring assembly, the pockets or blocks may be folded accordion-like style and connected with fasteners (not shown) so as to obtain a pocketed spring assembly which may be used in a bedding or seating product.

Referring now to FIGS. 4–7, there is illustrated another method of assembly for the spring retainer of the present invention. A plurality of spring retainers 10 may be incorporated into a spring assembly 104*a*, 104*b* by aligning a plurality of spring retainers 10 in a parallel manner such that each spring retainer is similarly oriented. In other words, the closed side 26 of one spring retainer is placed adjacent to an open side 27 of the next spring retainer so that all the spring retainers are oriented the same way. Once the spring retainers are so oriented, they are joined together with supplemental fabric strips 92, 93 to form a spring assembly 104.

Figure 4:
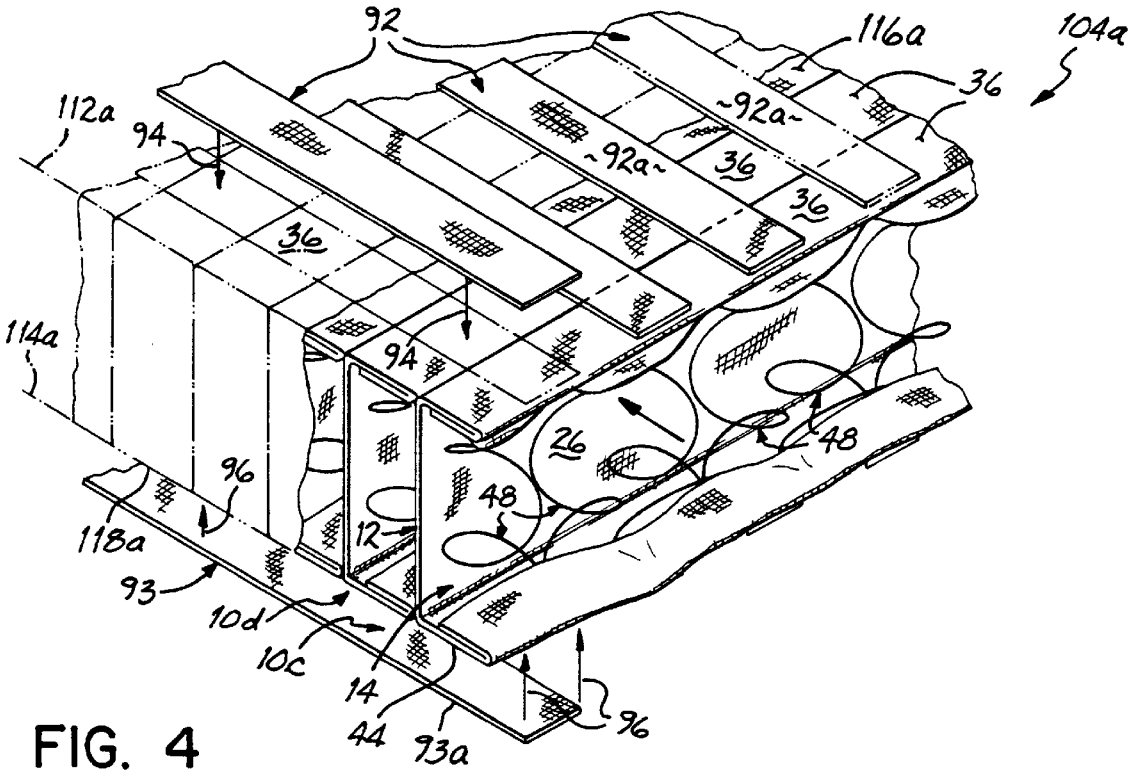
FIG. 4 is a partially disassembled perspective view of a spring assembly made by combining multiple spring retainers with supplemental fabric strips, the supplemental fabric strips extending perpendicular to the longitudinal dimension of the spring retainers.
Figure 5:
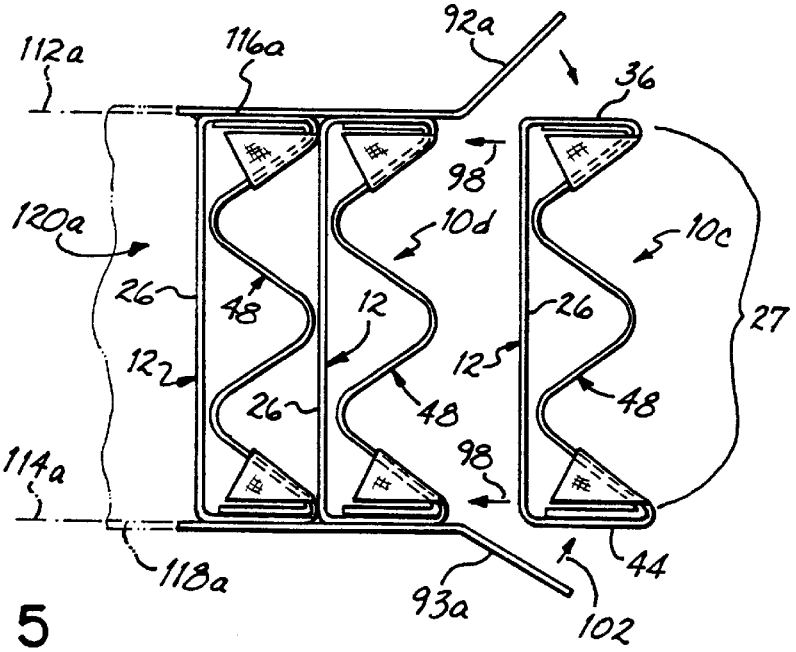
FIG. 5 is a partially disassembled side elevational view of the spring assembly of FIG. 4.

FIGS. 4 and 5 illustrate one embodiment of spring assembly 104*a* having a planar upper surface 116*a* in a top plane 112*a* and a planar lower surface 118*a* in a bottom plane 114*a*. As illustrated in FIGS. 4 and 5, the supplemental fabric strips 92, 93 may extend perpendicular to the longitudinal dimension of the spring retainers so that if the spring retainers are transversely oriented in a bedding product extending the width of the bedding product, i.e., from one side to the other side, the supplemental fabric strips 92, 93 would extend longitudinally. Although FIG. 4 illustrates the supplemental fabric strips 92, 93 being spaced apart from one another in both the top and bottom planes 112*a*, 114*a*, the supplemental fabric strips may be immediately adjacent one another as well.

Referring to FIG. 4, the supplemental fabric strips comprise upper strips 92*a* which are lowered in the direction of arrows 94 and secured to the upper ply 36 of the top portions 28 of fabric of the fabric retainers. Similarly, lower supplemental fabric strips 93*a* are moved upwardly in the direction of arrows 96 and secured to the lower plies 44 of the bottom portions 30 of the fabric of the spring retainers. The supplemental fabric strips 92*a*, 93*a* are spaced apart from one another and may extend either the full length or width of the mattress or bedding product depending on the orientation of the supplemental fabric strips. The supplemental fabric strips 92*a*, 93*a* may be attached to the fabric of the spring retainer by sewing, welding or gluing or any other conventional fastening means.

FIG. 5 illustrates an alternative method of making the spring assembly 104*a* of FIG. 4. This method requires a person (operator) or machine is to insert one of the spring retainers 10 at a time in the direction of arrows 98 toward a plurality of already joined spring retainers 120*a* so that the closed side 26 of the fabric retainer being inserted 10*c* is adjacent to the open side 27 of the endmost fabric retainer 10*d* of the joined retainers 120*a*. The upper supplemental fabric strips 93*a* are then lowered and the supplemental fabric strips 92*b* raised and secured to the top and bottom portions 28, 30 of fabric, respectively, of the spring retainer 10*c*. This process is repeated adding one spring retainer at a time until the appropriate length of spring assembly is obtained.

Figure 6:
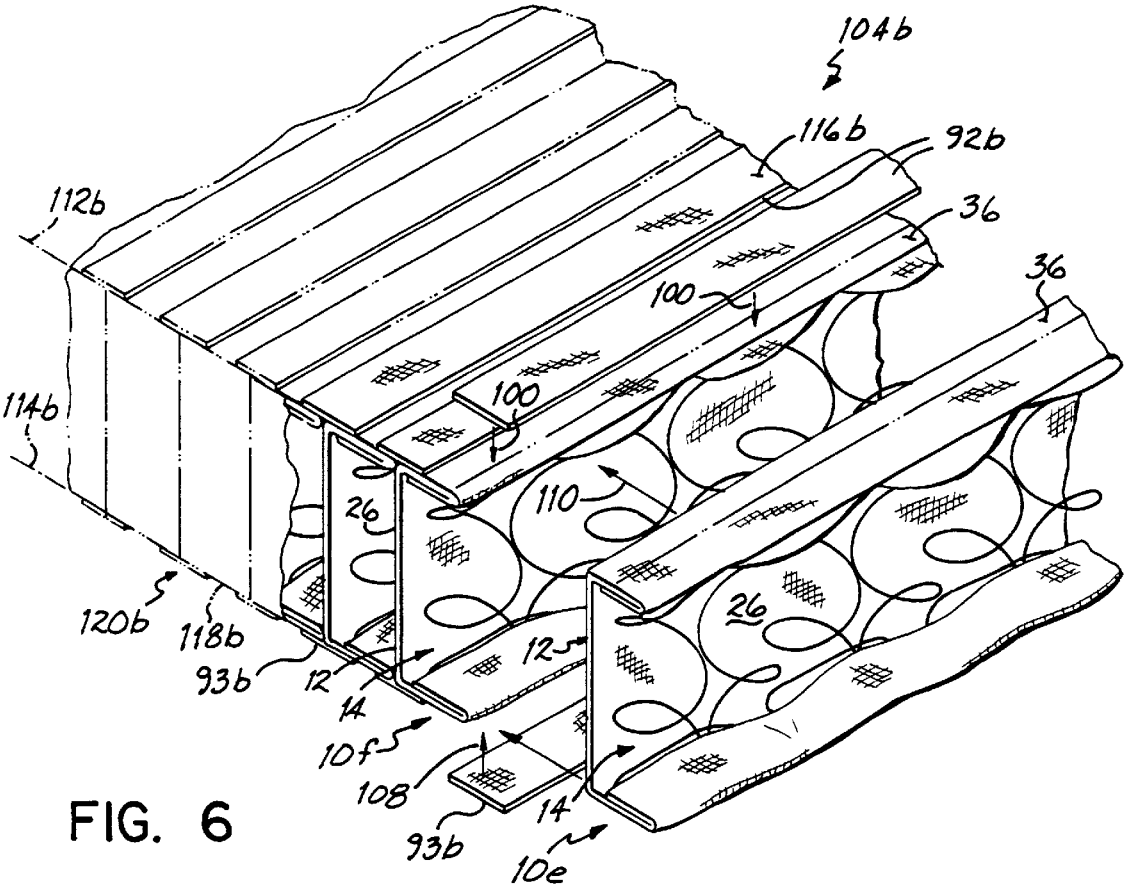
FIG. 6 is a partially disassembled perspective view of a spring assembly made of a plurality of spring retainers joined by supplemental fabric strips, the supplemental fabric strips extending generally parallel the longitudinal dimension of the spring retainers.
Figure 7:
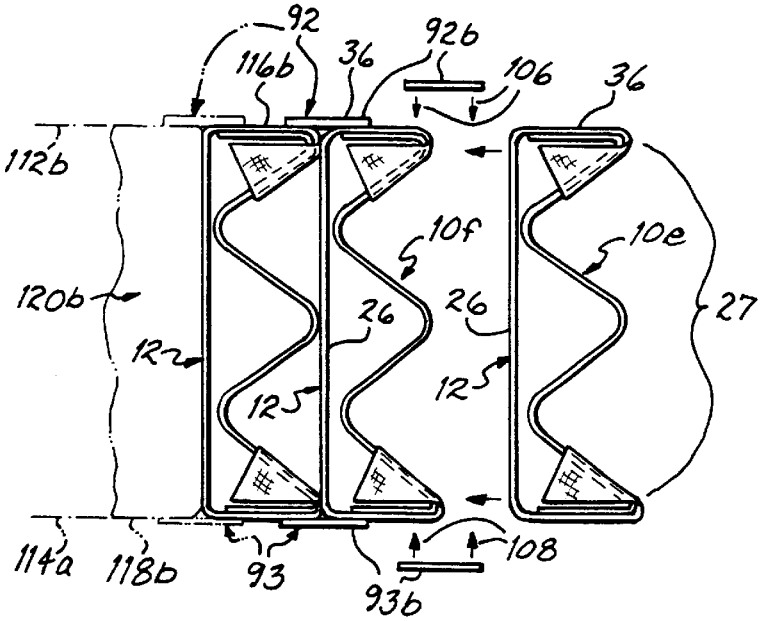
FIG. 7 is a partially disassembled side elevational view of the spring assembly of FIG. 6.

An alternative spring assembly 104*b* made of a plurality of spring retainers joined with supplemental fabric strips is illustrated in FIGS. 6 and 7. In this spring assembly 104*b*, a plurality of spring retainers 10 are aligned and placed side-to-side so that the closed side 26 of one fabric retainer abuts against the open side 27 of an adjacent retainer as in the spring assembly 104*a* of FIG. 4. The spring retainers 10 used to make the spring assembly 104*b* are all approximately the same height so that the top portions of fabric of the spring retainers lie in a common top plane 112*b* and the bottom portions lie in a common bottom plane 114*b*. The top portions of fabric of the spring retainers define a planar upper surface 116*b* of the spring assembly 104*b* in the top plane 112*b*. Likewise, the bottom portions of fabric of the spring retainers define a planar lower surface 118*b* in the bottom plane 114*b*.

In this spring assembly 104*b*, supplemental strips 92*b*, 93*b*, respectively are used to secure the spring retainers together. Referring to FIG. 7, upper supplemental fabric strips 92*b* are lowered in the directions of arrows 106 and supplemental fabric strips 93*b* are raised in the direction of arrows 108 until they rest on the upper and lower surfaces 116*b*, 118*b* of the spring assembly 104*b*. The supplemental fabric strips 92*b*, 93*b* extend generally parallel the longitudinal dimension of the spring retainers. A portion of each supplemental fabric strip 92*b* lies directly above the upper ply 36 of the top portions 28 of two adjacent spring retainers. Likewise, a portion of each supplemental fabric strip 93*b* lies underneath the lower ply 44 of a bottom portion 30 of two adjacent fabric retainers.

As illustrated in FIG. 6, preferably the supplemental fabric strips 92*b*, 93*b* extend the full longitudinal dimension of the spring retainers. However, it is within the purview of the invention of this application that the supplemental fabric strips 92*b*, 93*b* be cut into pieces and multiple pieces used to connect adjoining spring retainers.

As illustrated in FIGS. 6 and 7, the spring retainers may be added one at a time to a group of spring retainers or partial assembly 120*b* until an appropriate length or width of spring assembly is obtained. A new spring retainer 10*e* is moved from right to left in FIGS. 6 and 7 in the direction of arrows 110 so that the side portion of fabric 26, i.e., closed side of the spring retainer 10*e* is placed against the open side 27 of the endmost spring retainer 10*f* of the group of retainers 120*b*. When the spring retainer 10*e* comes into a position immediately adjacent spring retainer 92*f*, upper supplemental fabric strip 92*b* is moved downwardly in the direction of arrows 106 and a supplemental fabric strip 93*b* moved upwardly in the direction of arrows 108. The supplemental fabric strips 92*b*, 93*b* may again be joined by sewing, welding, gluing or any other attachment method to the adjoining spring retainers.

Another method of joining the adjacent spring retainers is to align the desired number of spring retainers in the manner illustrated in FIGS. 6 and 7 and then secure the supplemental fabric strips 92*b*, 93*b* to the planar upper and lower surfaces of the spring assembly. This is an alternative method to joining two adjacent spring retainers with two supplemental fabric strips and then adding an additional spring retainer and joining it to the existing group with two additional fabric strips and repeating this process.

Figure 8:
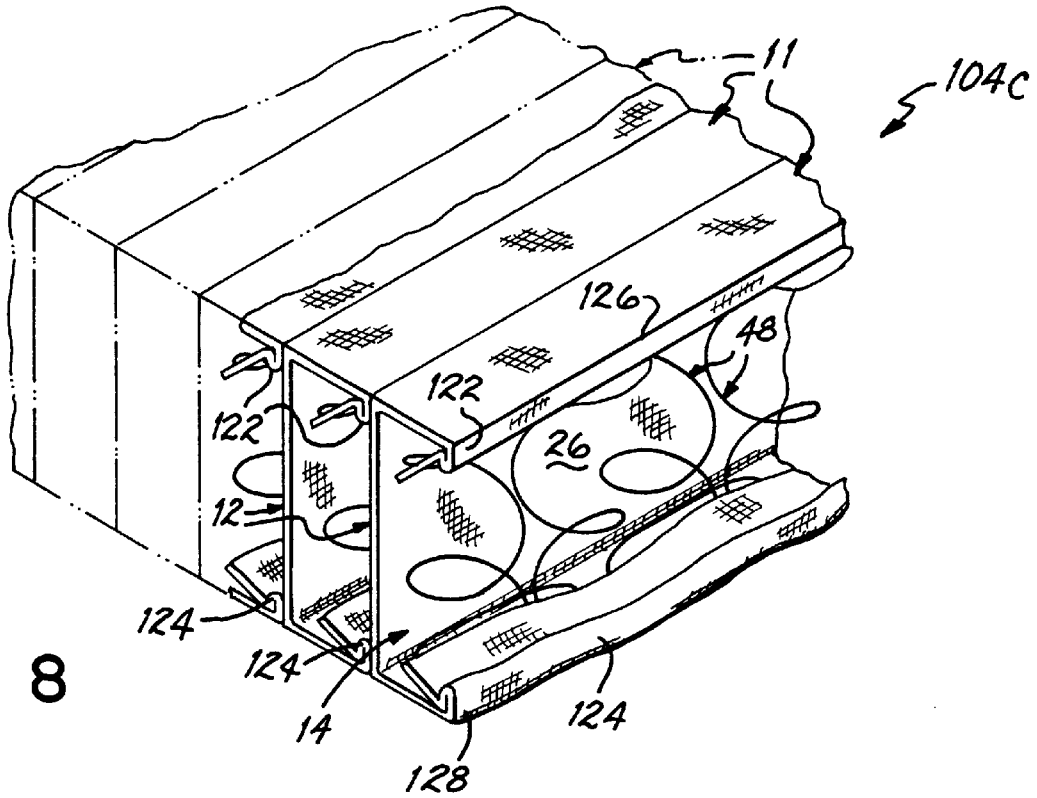
FIG. 8 is a perspective view of a spring assembly made with a plurality of aligned fabric retainers, double ply extension flaps of the spring retainers being joined to the side portions of fabric of adjacent retainers.
Figure 9:
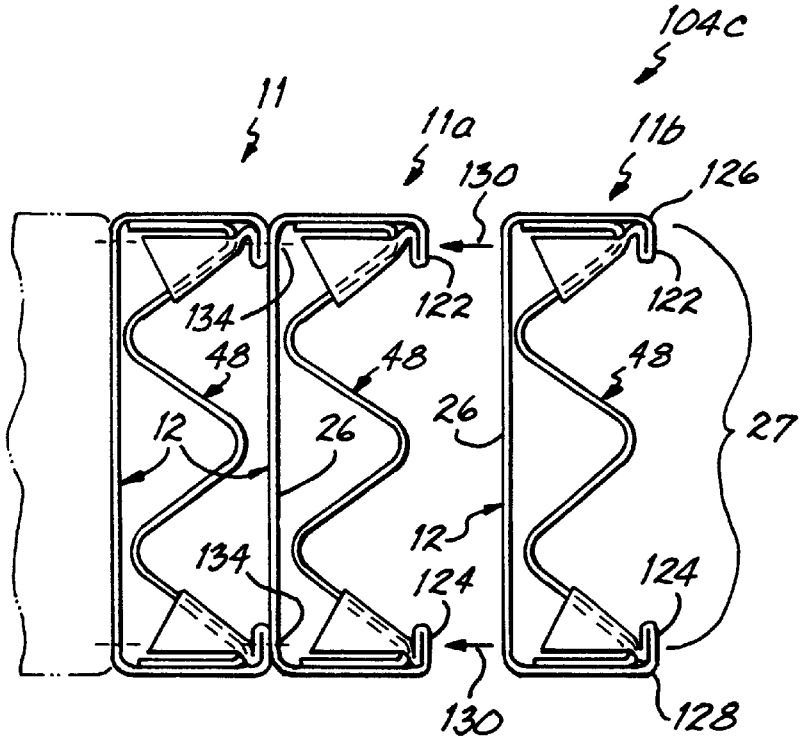
FIG. 9 is a partially disassembled side elevational view of the coil spring assembly of FIG. 8.

An alternative embodiment of the spring retainer of the present invention is illustrated in FIGS. 8 and 9. This spring retainer 11 has a two-ply upper extension flap 122 and a lower two-ply extension flap 124. In all other aspects, the spring retainer 11 is identical to spring retainer 10 which does not have extension flaps. The extension flap 122 is formed by joining the upper and lower plies 36, 38 of the top portion 28 of fabric along a longitudinally extending seam 126. Likewise, the extension flap 124 is formed by joining the upper and lower plies 42, 44 of the bottom portion 30 of fabric along longitudinally extending seam 128. The plies may be joined by sewing, gluing or any other method of joining two pieces of fabric together. The two-ply extension flap 122 is folded downwardly and extension flap 124 is folded upwardly into a substantially vertical position in the embodiment illustrated in FIGS. 8 and 9.

FIG. 8 illustrates a spring assembly 104*c* formed by joining multiple spring retainers 11 having extension flaps 122, 124. As best illustrated in FIG. 9, one spring retainer 11 at a time is moved in the direction of arrows 130 until the closed side portion 26 of one spring retainer 11*b* abuts against the open side 27 of the endmost spring retainer 11*a*. The spring retainers 11 are joined together by securing the extension flaps 122, 124 of one spring retainer 11*a* to the side portion of fabric 26 of an adjacent spring retainer 11*b* by sewing, gluing or welding or any other method. The extension flaps 122, 124 of the spring retainers 11 may also be secured to the closed side portion 26 of adjacent spring retainers by fasteners 134. FIG. 8 illustrates a spring assembly 104*c* formed by this method.

Figure 10:
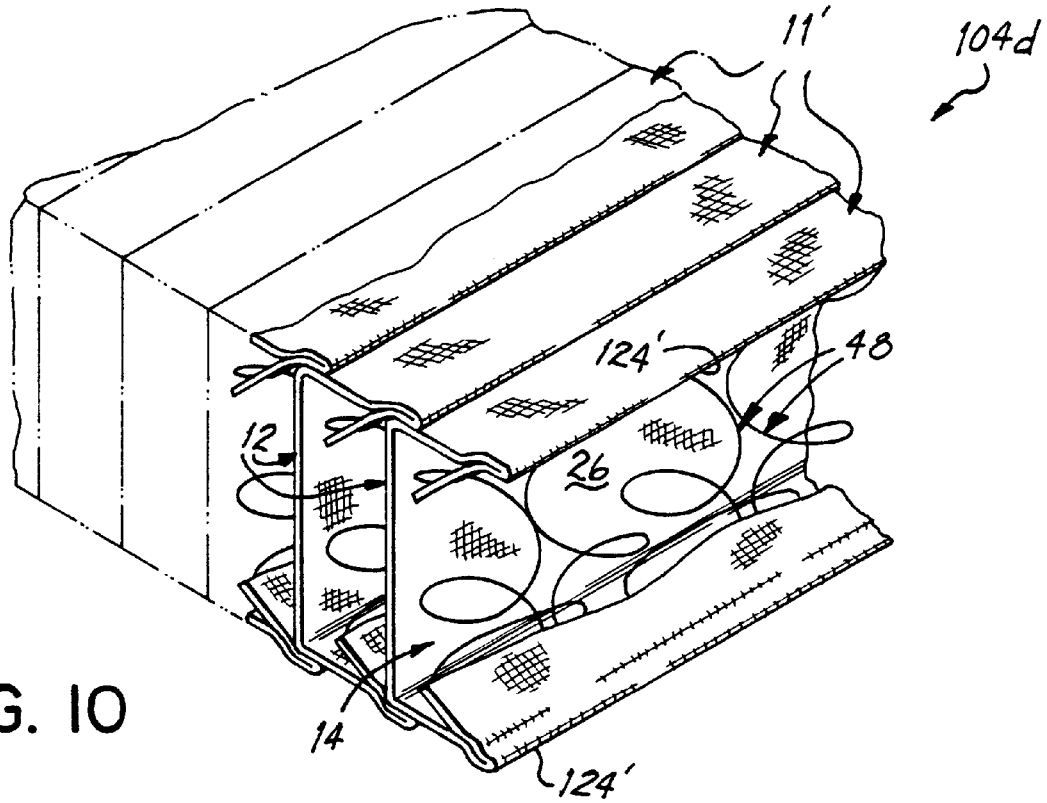
FIG. 10 is a perspective view of a spring assembly made of a plurality of aligned fabric retainers, double ply extension flaps of the fabric retainers being joined to top and bottom portions of fabric of adjacent retainers.
Figure 11:
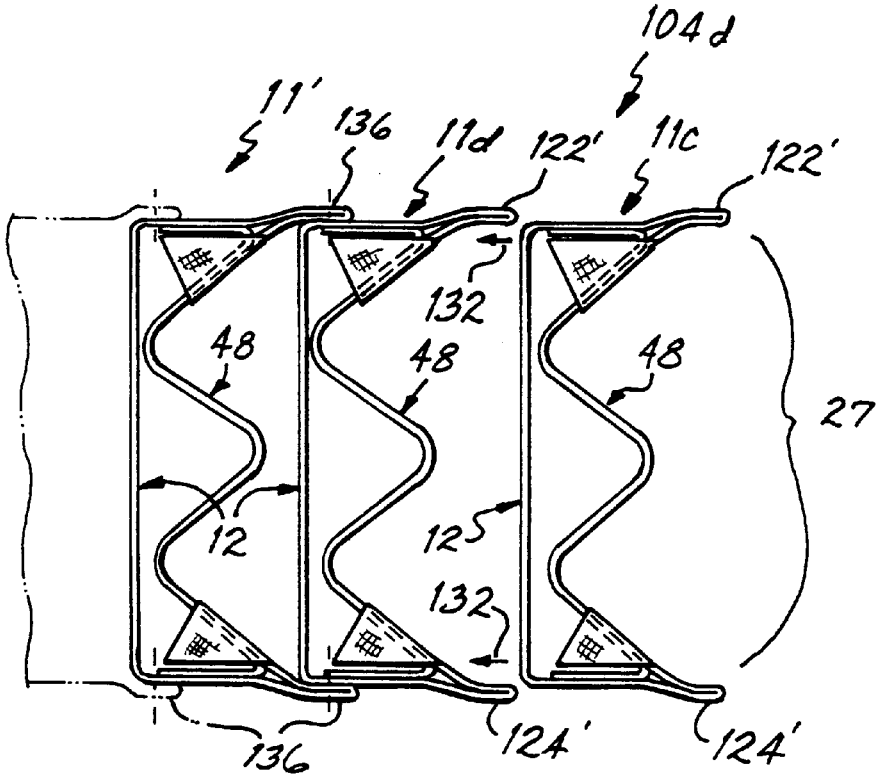
FIG. 11 is a partially disassembled side elevational view of the spring assembly of FIG. 10.

Referring now to FIGS. 10 and 11, spring retainers 11' having two-ply extension flaps 122', 124', may be joined together to form a spring assembly 104*d*. The spring retainers 11' are similar to spring retainers 11 in that they have two ply extension flaps. The spring retainers 11' are aligned with each other in a manner similar to that described hereinabove so that all the spring retainers are oriented similarly. However, as best illustrated in FIG. 11, the upper 10 extension flap 122' of one spring retainer 11' is placed over the top portion of fabric of an adjacent spring retainer and the lower extension flap 124' is placed underneath the bottom portion of fabric of the adjacent spring retainer 11' to form the spring assembly 104*d* as illustrated in FIG. 10. As illustrated in FIG. 11, a new spring retainer 11*c* is moved in the direction of arrows 132 so that the side portion of fabric 26 of spring retainer 11*c* is adjacent the open side 27 of the endmost spring retainer 11*d*. The extension flap 122' of spring retainer 11*d* is placed over the top portion of fabric of spring retainer 11*c* and the lower extension flap 124' of spring retainer 11*d* placed underneath the bottom portion of fabric 30 of spring retainer 11*c*. The spring retainers are then joined with fasteners 136. These fasteners may be a longitudinally extending seam, staples, a line of glue or any other type of fastener.

Figure 12:
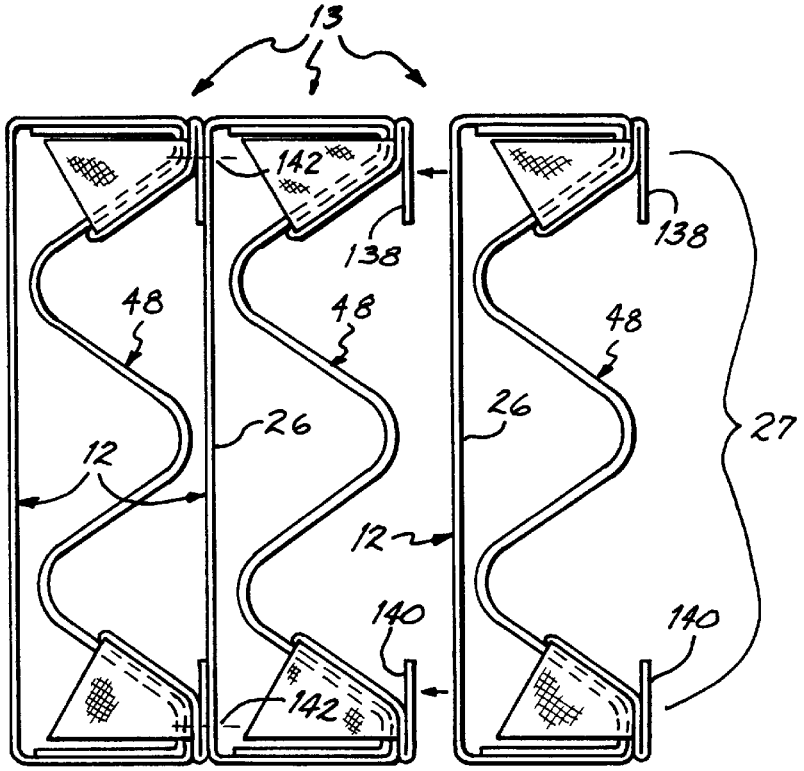
FIG. 12 is a partially disassembled side elevational view of an alternative embodiment of the spring retainer of the present invention having a single ply extension flap joined to a side portion of fabric of an adjacent spring retainer in order to form a spring assembly.
Figure 13:
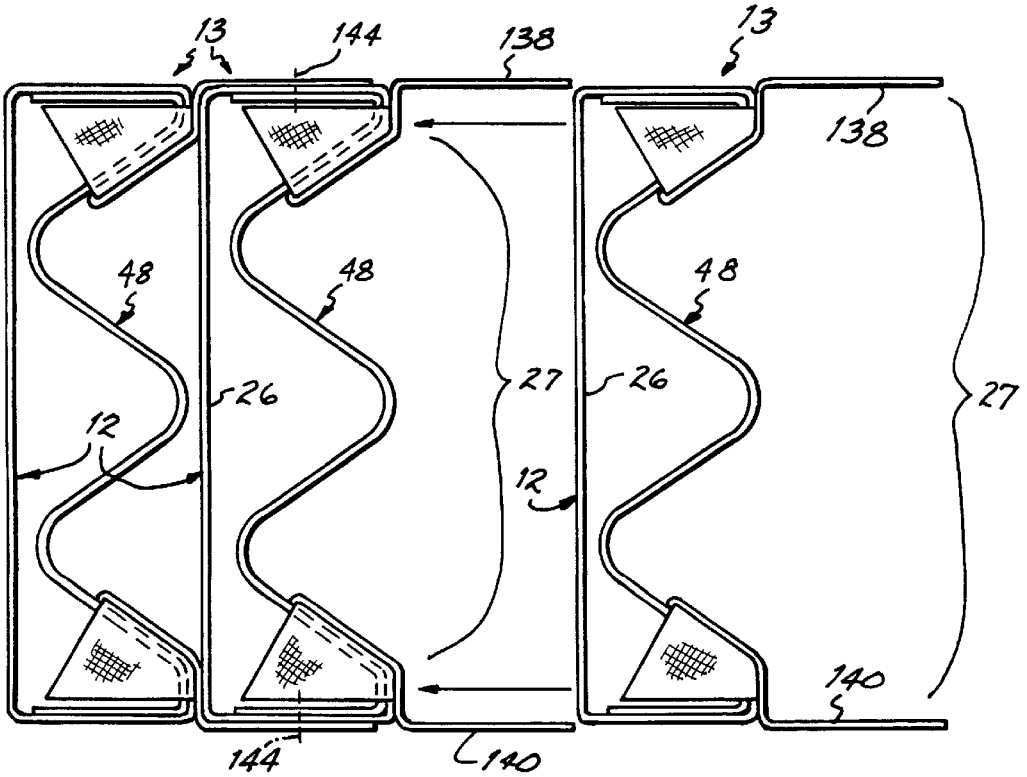
FIG. 13 is a partially disassembled side elevational view of a spring assembly made up of a plurality of spring retainers, each spring retainer having a single ply extension flap, the extension flaps being secured to the top and bottom portions of fabric of adjacent spring retainers.

Referring now to FIGS. 12 and 13, an alternative embodiment of spring retainer is illustrated. In this embodiment of spring retainer 13, the top portion of fabric is doubled back upon itself so as to form a single ply upper extension flap 138. The extension flap 138 may extend horizontally as illustrated in FIG. 13 or may be downwardly turned as illustrated in FIG. 12. Likewise, the bottom portion of fabric of the spring retainer 13 is raised and folded downwardly upon itself and terminates in a lower extension flap 140. The lower extension flap 140 may be horizontally oriented as shown in FIG. 13 or upwardly turned and vertically oriented as shown in FIG. 12. As illustrated in FIG. 12, the single ply extension flaps 138 and 140 may be joined to the side portion 26 of an adjacent spring retainer and joined with fasteners 142 in order to construct a spring assembly.

Referring now to FIG. 13, adjacent spring retainers 13 may be joined to each other with the extension flap 138 of one spring retainer being placed over the top of the top portion of fabric of an adjacent spring retainer and likewise the extension flap 140 being placed underneath the bottom portion of fabric of an adjacent spring retainer. Extension flaps 138, 140 are then secured to the top and bottom portions of fabric of the adjacent spring retainers with fasteners 144, the fasteners 144 being generally vertically oriented.

Figure 14:
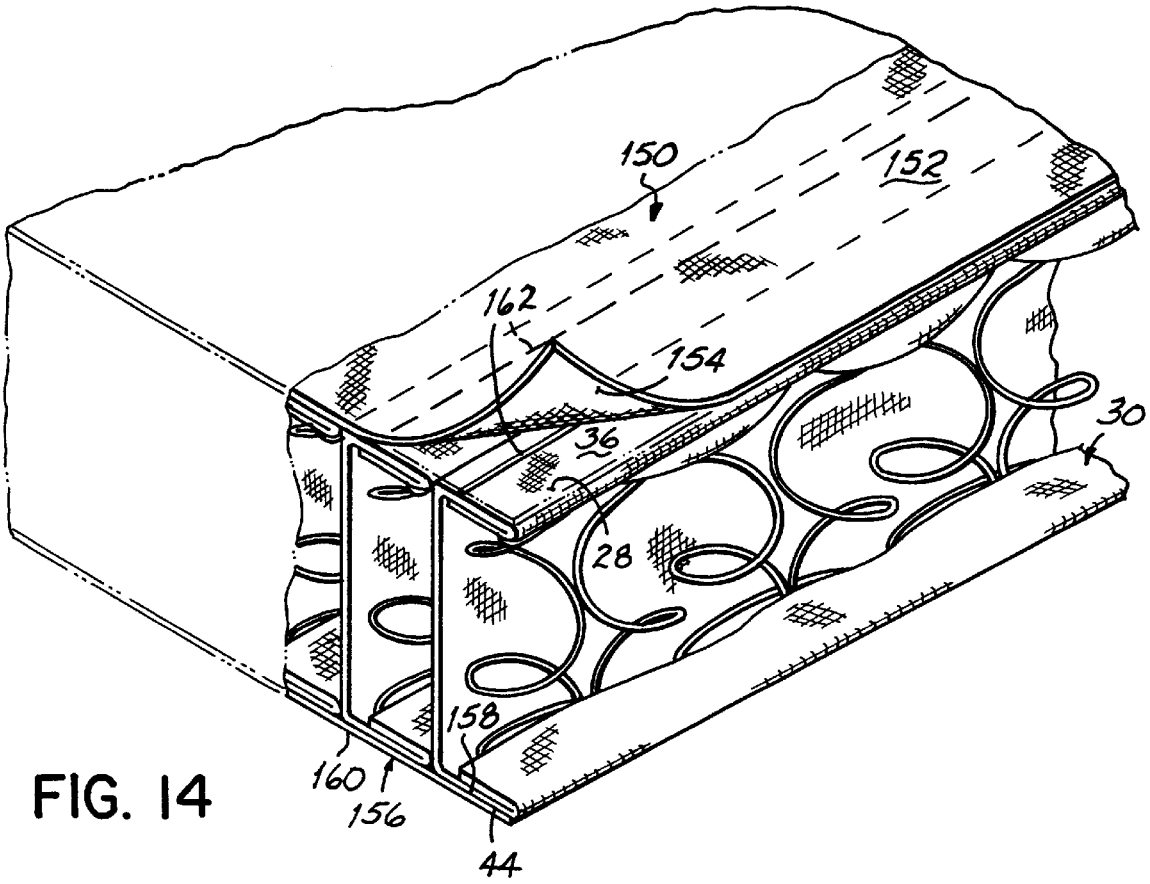
FIG. 14 is a partially disassembled perspective view of a spring assembly made by combining multiple spring retainers with upper and lower sheets.

Referring to FIG. 14, an alternative embodiment of spring assembly is illustrated. This embodiment of spring assembly may be used with any of the above-mentioned spring retainers but is preferably utilized with spring retainers such as those illustrated in FIG. 1 which lack the extension flaps. This embodiment of spring assembly is similar to the embodiments illustrated in FIGS. 4–7 in which supplemental fabric strips are utilized to hold a plurality of spring retainers similarly oriented in an assembled relationship to form the spring assembly. However, in this embodiment, rather than utilizing supplemental fabric strips, at least one sheet is secured to the spring retainers in order to hold the spring retainers together. Focusing on FIG. 14, an upper sheet 150 is placed on top of a plurality of similarly aligned spring retainers. The upper sheet 150 has an upper surface 152 and a lower surface 154. The lower surface 154 of the upper sheet 150 abuts against and is secured to the upper plies 36 of the top portions 28 of fabric of the spring retainers. Similarly, a lower sheet 156 having an upper surface 158 and a lower surface 160 is secured to the lower plies 44 of the bottom portions 30 of fabric of the spring retainers. These upper and lower sheets 150, 156 preferably extend the entire length and width of the spring assembly. However, the upper and lower sheets 150, 156 may have a length or width which is less than or greater than the length and width of the spring assembly. Additionally, more than one sheet may be secured to the top and bottom portions 28, 30 of fabric, either on top of one another or side-by-side.

In order to secure the upper and lower sheets 150, 156 to the top and bottom portions 28, 30 respectively of the spring retainers, glue lines 162 are preferably laid parallel to the longitudinal dimension of the spring retainers. Glue, preferably a hot melt glue, is placed between the lower surface 154 of the upper sheet 150 and the upper ply 36 of the top portion 28 of fabric of the spring retainers. Similarly, glue lines (not illustrated) are placed between the lower plies 44 of the bottom portions 36 of fabric of the spring retainers and the upper surface 158 of the lower sheet 156. One glue line may secure each spring retainer to an upper sheet and a separate glue line may secure the same spring retainer to the lower sheet. These glue lines are illustrated as being linear, however, alternative patterns which are non-linear, random, a dashed-line or any other patterns may be utilized as well. Each spring retainer need not be secured with a glue line to the upper and lower sheets. For example, every other fabric retainer may be glued to the upper and lower sheets. As an alternative to glue, ultrasonic welds, staples, hog rings or other fasteners may be used to secure the upper and lower sheets to the top and bottom portions of fabric of the spring retainers. The upper and lower sheets may be made of the same material as the fabric of the spring retainers, any woven or non-woven fabric, plastic or any other material.

While we have described several embodiments of the present invention, persons skilled in the art will appreciate changes and modifications which may be made without departing from the spirit of the invention. Therefore, we do not intend to be limited except by the scope of the following claims.

What is claimed is:

1. A spring retainer having a longitudinal dimension and a transverse dimension, said longitudinal dimension being greater than said transverse dimension, said spring retainer comprising:

a continuous piece of fabric folded so as to form longitudinally extending top, bottom and side portions, one side of said spring retainer being open, said continuous piece of fabric being overlapped in said top and bottom portions so that said top and bottom portions each have an upper ply and a lower ply defining a receptacle therebetween, a band of coil springs made of a single length of wire shaped to form a plurality of coil springs arranged in a row, each of said coil springs having an upper and lower end turn, said band of coil springs being located between said top and bottom portions of fabric with said end turns of said coil springs being inserted into said receptacles, said end turns of said coil springs of said band being held in place by multiple connections, each of said connections securing an upper ply to a lower ply.

2. The spring retainer of claim 1 wherein the end turns of two coil springs are located between adjacent connections.

3. The spring retainer of claim 1 wherein said connections are welds.

4. The spring retainer of claim 1 wherein said connections are sewn lines.

5. The spring retainer of claim 1 wherein said connections are lines of glue.

6. A spring retainer having a longitudinal dimension and a transverse dimension, said longitudinal dimension being greater than said transverse dimension, said spring retainer comprising:

a band of coil springs made of a single length of wire shaped to form a plurality of coil springs arranged in a longitudinally extending row, each coil spring having an upper end turn located in a top face of the band and a lower end turn located in a bottom face of the band, adjacent end turns being connected by interconnecting segments in said top and bottom faces of said band, a continuous piece of fabric folded around said band of coil springs so as to form longitudinally extending top, bottom and side portions, one side of said spring retainer being open, said top and bottom portions of said continuous piece of fabric being overlapped so that said top and bottom portions each have an upper ply and a lower ply, the end turns of said coil springs of said band being located between said plies, said coil springs of said band being secured in place by multiple transversely extending connections, each of said connections securing one of said plies to the other of said plies in one of said top and bottom portions of said continuous piece of fabric.

7. The spring retainer of claim 6 wherein the end turns of two adjacent coil springs of said band are located between adjacent connections.

8. The spring retainer of claim 6 wherein said spring retainer is joined to other spring retainers in a spring assembly.

9. The spring assembly of claim 8 wherein said spring retainers are joined together with a plurality of supplemental fabric strips.

10. The spring assembly of claim 8 wherein said spring retainers are sewn together.

11. The spring assembly of claim 8 wherein said spring retainers are welded together.

12. The spring assembly of claim 8 wherein said spring retainers are glued together.

13. A method of constructing a spring retainer comprising the steps of:

folding a piece of fabric longitudinally so as to form one side portion, an overlapped top portion and an overlapped bottom portion, leaving one side of said spring retainer open, said top and bottom portions each having an upper ply of fabric and a lower ply of fabric defining a receptacle therebetween, providing a band of coil springs made of a single length of wire shaped to form a plurality of coil springs arranged in a longitudinally extending row, each coil spring having an upper end turn located in a top face of the band and a lower end turn located in a bottom face of the band, adjacent end turns being connected by interconnecting segments in said top and bottom faces of said band, inserting said end turns of said coil springs into said receptacles, securing said end turns of said coil springs in place by attaching the plies of said top and bottom portions of fabric to each other.

14. The method of claim 13 wherein securing step comprises welding said plies of fabric at select locations.

15. The method of claim 13 wherein securing step comprises sewing said plies of fabric at select locations.

16. The method of claim 13 wherein securing step comprises glueing said plies of fabric at select locations.

17. A pocketed spring assembly for use in the manufacture of bedding and seating products, said pocketed spring assembly comprising:

a plurality of pockets joined together, each pocket containing a spring retainer, said spring retainer comprising:

a band of coil springs made of a single length of wire shaped to form a plurality of coil springs arranged in a row, each coil spring having an upper end turn located in a top face of the band and a lower end turn located in a bottom face of the band, adjacent end turns being connected by interconnecting segments in said top and bottom faces of said band, a continuous piece of fabric folded so as to form longitudinally extending top, bottom and side portions, one side of said fabric retainer being open, said top and bottom portions of said continuous piece of fabric being overlapped so that said top and bottom portions each have an upper ply and a lower ply defining a receptacle therebetween, the end turns of said coil springs of said band being located in said receptacles, said coil springs of said band being held in place by multiple connections, each of said connections securing an upper ply to a lower ply.

18. The pocketed spring assembly of claim 17 wherein said pockets are glued together.

19. The pocketed spring assembly of claim 17 wherein said pockets are integrally connected, each pocket being defined by two sheets of fabric joined together.

20. A pocketed spring assembly for use in the manufacture of bedding and seating products, said assembly having an upper and lower planar surface in top and bottom planes respectively and comprising:

a plurality of hingedly connected fabric pockets, each pocket containing a spring retainer, wherein said pockets are defined between two sheets of fabric, a first sheet and a second sheet, each sheet containing a plurality of folds therein, said folds separating said pockets from one another and extending inwardly from one of said upper and lower planar surfaces, said spring retainer comprising:

a band of coil springs made of a single length of wire shaped to form a plurality of coil springs arranged in a row, each coil spring having an upper end turn located in a top face of the band and a lower end turn located in a bottom face of the band, adjacent end turns being connected by interconnecting segments in said top and bottom faces of said band, a continuous piece of fabric folded so as to form longitudinally extending top, bottom and side portions, one side of said strip being open, said top and bottom portions of said continuous piece of fabric being overlapped so that said top and bottom portions each have an upper ply and a lower ply defining a receptacle therebetween, the end turns of said coil springs of said band being located in said receptacles, said coil springs of said band being held in place by multiple connections, each of said connections securing an upper ply to a lower ply.

21. The pocketed spring assembly of claim 20 wherein said first and second sheets are joined with lines of attachment.

22. The pocketed spring assembly of claim 21 wherein said lines of attachment are located in said upper and lower planar surfaces of said pocketed spring assembly.

23. A spring assembly for use in the manufacture of bedding and seating products, said assembly having an upper and lower planar surface in top and bottom planes respectively and comprising:

a plurality of parallel, aligned spring retainers, each spring retainer comprising a band of coil springs made of a single length of wire shaped to form a plurality of coil springs arranged in a row, each coil spring having an upper end turn located in a top face of the band and a lower end turn located in a bottom face of the band, adjacent end turns being connected by interconnecting segments in said top and bottom faces of said band, a continuous piece of fabric folded so as to form longitudinally extending top, bottom and side portions, one side of said spring retainer being open, said top and bottom portions of said continuous piece of fabric being overlapped so that said top and bottom portions each have an upper ply and a lower ply defining a receptacle therebetween, the end turns of said coil springs of said band being inserted in said receptacles, said coil springs of said band being held in place by multiple connections, each of said connections securing an upper ply to a lower ply, said spring retainers being secured to each other with multiple supplemental fabric strips, said supplemental fabric strips being located in one of said upper and lower planar surfaces of said spring assembly.

24. The spring assembly of claim 23 wherein said assembly has a longitudinal dimension and a transverse dimension, said longitudinal dimension being greater than said transverse dimension, said supplemental fabric strips being longitudinally oriented and said spring retainers being transversely oriented.

25. The spring assembly of claim 23 wherein said supplemental fabric strips and said spring retainers are parallel.

26. The spring assembly of claim 23 wherein said supplemental fabric strips and said spring retainers are perpendicular.

27. The spring assembly of claim 23 wherein an open side of one retainer is adjacent a side portion of fabric of an adjacent retainer.

28. A method of making a spring assembly, said assembly having an upper and lower planar surface in top and bottom planes respectively, said method comprising the steps of:

aligning a plurality of spring retainers in a parallel manner such that each spring retainer is similarly oriented, each spring retainer comprising a band of coil springs made of a single length of wire shaped to form a plurality of coil springs arranged in a row, each coil spring having an upper end turn located in a top face of the band and a lower end turn located in a bottom face of the band, adjacent end turns being connected by interconnecting segments in said top and bottom faces of said band, a continuous piece of fabric folded so as to form longitudinally extending top, bottom and side portions, one side of said spring retainer being open, said top and bottom portions of said continuous piece of fabric being overlapped so that said top and bottom portions each have an upper ply and a lower ply defining a receptacle therebetween, the end turns of said coil springs of said band being located in said receptacles, said coil springs of said band being held in place by multiple connections, each of said connections securing an upper ply to a lower ply, securing said spring retainers to each other with multiple supplemental fabric strips, said supplemental fabric strips being located in one of said upper and lower planar surfaces of said spring assembly.

29. The method of making a spring assembly of claim 28 wherein said securing step comprises welding said supplemental fabric strips to said spring retainers.

30. The method of making a spring assembly of claim 28 wherein said securing step comprises sewing said supplemental fabric strips to said spring retainers.

31. The method of making a spring assembly of claim 28 wherein said securing step comprises gluing said supplemental fabric strips to said spring retainers.

32. A spring assembly for use in the manufacture of bedding and seating products, said assembly having an upper and lower planar surface in top and bottom planes respectively and comprising:

a plurality of parallel, aligned spring retainers, each spring retainer comprising a band of coil springs made of a single length of wire shaped to form a plurality of coil springs arranged in a row, each coil spring having an upper end turn located in a top face of the band and a lower end turn located in a bottom face of the band, adjacent end turns being connected by interconnecting segments in said top and bottom faces of said band, a continuous piece of fabric folded so as to form longitudinally extending top, bottom and side portions, one side of said retainer being open, said top and bottom portions of said continuous piece of fabric being overlapped so that said top and bottom portions each have an upper ply and a lower ply defining a receptacle therebetween and an extension flap, the end turns of said coil springs of said band being inserted into said receptacles, said coil springs of said band being held in place by multiple transversely extending connections, each of said connections securing a upper ply to a lower ply, said spring retainers being secured to each other with said extension flaps, said extension flaps of one retainer being secured to an adjacent spring retainer.

33. The spring assembly of claim 32 wherein the extension flaps of said one spring retainer are secured to a top and bottom portion of fabric of said adjacent spring retainer.

34. The spring assembly of claim 32 wherein the extension flaps of said one spring retainer are secured to a side portion of fabric of said adjacent spring retainer.

35. A method of making a spring assembly, said assembly having an upper and lower planar surface in top and bottom planes respectively, said method comprising the steps of:

aligning a plurality of spring retainers in a parallel manner such that each spring retainer is similarly oriented, each spring retainer comprising a band of coil springs made of a single length of wire shaped to form a plurality of coil springs arranged in a row, each coil spring having an upper end turn located in a top face of the band and a lower end turn located in a bottom face of the band, adjacent end turns being connected by interconnecting segments in said top and bottom faces of said band, a continuous piece of fabric folded so as to form longitudinally extending top, bottom and side portions, one side of said retainer being open, said top and bottom portions of said continuous piece of fabric being overlapped so that said top and bottom portions each have an upper ply and a lower ply defining a receptacle therebetween and extension flaps, the end turns of said coil springs of said band being located in said receptacles, said coil springs of said band being held in place by multiple transversely extending connections, each of said connections securing an upper ply to a lower ply, securing said spring retainers to each other with fasteners, said fasteners securing an extension flap of one spring retainer to the fabric of an adjacent spring retainer.

36. The method of making a spring assembly of claim 35 wherein said securing step comprises welding said extension flaps of said one spring retainer to the fabric of said adjacent spring retainer.

37. The method of making a spring assembly of claim 35 wherein said securing step comprises sewing said extension flaps of said one spring retainer to the fabric of said adjacent spring retainer.

38. The method of making a spring assembly of claim 35 wherein said securing step comprises gluing said extension flaps of said one spring retainer to the fabric of said adjacent spring retainer.

39. A spring assembly for use in the manufacture of bedding and seating products, said assembly having an upper and lower planar surface in top and bottom planes respectively and comprising:

a plurality of parallel, aligned spring retainers, each spring retainer comprising a band of coil springs made of a single length of wire shaped to form a plurality of coil springs arranged in a row, each coil spring having an upper end turn located in a top face of the band and a lower end turn located in a bottom face of the band, adjacent end turns being connected by interconnecting segments in said top and bottom faces of said band, a continuous piece of fabric folded so as to form longitudinally extending top, bottom and side portions, one side of said spring retainer being open, said top and bottom portions of said continuous piece of fabric being overlapped so that said top and bottom portions each have an upper ply and a lower ply defining a receptacle therebetween, the end turns of said coil springs of said band being inserted in said receptacles, said coil springs of said band being held in place by multiple connections, each of said connections securing an upper ply to a lower ply, said spring retainers being secured to each other with sheets, said sheets being located in said upper and lower planar surfaces of said spring assembly.

40. A method of making a spring assembly, said assembly having an upper and lower planar surface in top and bottom planes respectively, said method comprising the steps of:

aligning a plurality of spring retainers in a parallel manner such that each spring retainer is similarly oriented, each spring retainer comprising a band of coil springs made of a single length of wire shaped to form a plurality of coil springs arranged in a row, each coil spring having an upper end turn located in a top face of the band and a lower end turn located in a bottom face of the band, adjacent end turns being connected by interconnecting segments in said top and bottom faces of said band, a continuous piece of fabric folded so as to form longitudinally extending top, bottom and side portions, one side of said spring retainer being open, said top and bottom portions of said continuous piece of fabric being overlapped so that said top and bottom portions each have an upper ply and a lower ply defining a receptacle therebetween, the end turns of said coil springs of said band being located in said receptacles, said coil springs of said band being held in place by multiple connections, each of said connections securing an upper ply to a lower ply, securing said spring retainers to each other with at least one sheet, said at least one sheet being located in one of said upper and lower planar surfaces of said spring assembly.

41. The method of making a spring assembly of claim 40 wherein said securing step comprises welding said at least one sheet to said spring retainers.

42. The method of making a spring assembly of claim 40 wherein said securing step comprises sewing said at least one sheet to said spring retainers.

43. The method of making a spring assembly of claim 40 wherein said securing step comprises gluing said at least one sheet to said spring retainers.

* * * * *